US011826886B2

(12) United States Patent
Koehler

(10) Patent No.: US 11,826,886 B2
(45) Date of Patent: Nov. 28, 2023

(54) ASSEMBLY METHOD AND ASSEMBLY AID WITH MAGNETIC ELEMENT

(71) Applicant: Rolls-Royce Deutschland Ltd & Co KG, Blankenfelde-Mahlow (DE)

(72) Inventor: Stephan Koehler, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 610 days.

(21) Appl. No.: 16/700,410

(22) Filed: Dec. 2, 2019

(65) Prior Publication Data

US 2020/0171630 A1 Jun. 4, 2020

(30) Foreign Application Priority Data

Nov. 30, 2018 (DE) ..... 10 2018 220 699.6

(51) Int. Cl.
*B25B 23/12* (2006.01)
*F01D 25/28* (2006.01)

(52) U.S. Cl.
CPC ..... *B25B 23/12* (2013.01); *F01D 25/285* (2013.01); *F05D 2240/14* (2013.01)

(58) Field of Classification Search
CPC ... B25B 23/12; F01D 25/285; F05D 2230/64; F05D 2240/14; F05D 2260/32
USPC ..... 29/41; 269/8; 81/438
See application file for complete search history.

(56) References Cited

U.S. PATENT DOCUMENTS 2,367,582 A * 1/1945 Honyoust ..... B23B 47/28 408/76
2,379,136 A * 6/1945 Erwin ..... B23K 37/0435 269/8
4,291,467 A * 9/1981 Shultz, Jr. ..... B43L 13/22 33/561.2
4,300,754 A * 11/1981 Lawrence ..... B23K 37/0435 269/208
4,974,274 A * 12/1990 Compton ..... B21J 15/12 29/521
4,989,313 A * 2/1991 Dzurko ..... B25B 11/002 29/281.4

(Continued)

FOREIGN PATENT DOCUMENTS

DE 102014106658 A1 11/2015

OTHER PUBLICATIONS

German Search Report dated Aug. 13, 2019 for counterpart German Patent Application No. 10 2018 220 699.6.

*Primary Examiner* — Brian D Keller
*Assistant Examiner* — Abbie E Quann
(74) *Attorney, Agent, or Firm* — SHUTTLEWORTH & INGERSOLL, PLC; Timothy J. Klima

(57) ABSTRACT

The proposed solution relates in particular to a method for assembling an engine assembly having a first engine component and a second engine component, wherein at least one fastening element is first of all arranged on an assembly aid, the at least one fastening element is arranged on the first engine component via the assembly aid and is held in an assembly position under the action of at least one magnetic element of the assembly aid, the at least one fastening element is fixed to the second engine component, and the assembly aid is removed again from the first engine component.

16 Claims, 5 Drawing Sheets

(56) References Cited

U.S. PATENT DOCUMENTS

| | | | | |
|---|---|---|---|---|
| 5,711,515 | A * | 1/1998 | Nishimura | B25B 1/2463 269/902 |
| 6,279,218 | B1 * | 8/2001 | Lezuch | E05B 17/06 29/271 |
| 2014/0053388 | A1 * | 2/2014 | Mazzei | E05B 85/045 29/464 |

* cited by examiner

ASSEMBLY METHOD AND ASSEMBLY AID WITH MAGNETIC ELEMENT

This application claims priority to German Patent Application DE102018220699.6 filed Nov. 30, 2018, the entirety of which is incorporated by reference herein.

The proposed solution relates in particular to a method for assembling an engine assembly, in which first and second engine components have to be secured to each other via at least one fastening element.

In the region of an engine, engine components frequently have to be secured to one another manually since an automated assembly is impossible because of the complexity of the engine. Against this background, the engine parts frequently also to have to be mounted in a certain spatial position in order to make possible connecting points accessible at all for a fitter and/or a tool. It is also known in this connection in practice that fastening elements, such as, for example, screw bolts, are locked on a first engine component in holding elements, which are provided merely for the assembly and are formed integrally on the engine component, before the first engine component is arranged as specified on another, second engine component, since, after the two engine components are arranged on each other, the corresponding fastening elements would no longer be able to be readily placed at the fastening points provided for them. The corresponding fastening elements subsequently still have to be transferred into a securing position, in which the two engine components are secured to each other as specified via the fastening elements.

However, a disadvantage of such an assembly method is that possible holding elements, for example threaded sleeves, for specifying an assembly position of the fastening elements are integrated permanently on an engine component, said holding elements having no function once the two engine components are secured to each other as specified. Said holding elements which are therefore provided on an engine component merely for the assembly therefore increase the weight and the costs of the corresponding engine assembly although the corresponding holding elements are required merely for the assembly.

Against this background, the proposed solution is based on the object of further improving a method for assembling an engine assembly.

This object is achieved both with an assembly method and also with an assembly aid as disclosed herein.

In a proposed method for assembling an engine assembly which has at least one first engine component and a second engine component

- at least one fastening element is first of all arranged on an assembly aid,
- the at least one fastening element is arranged on the first engine component via the assembly aid and is held in an assembly position under the action of at least one magnetic element of the assembly aid,
- the at least one fastening element (2) is fixed to the second engine component (4), and
- the assembly aid is removed again from the first engine component.

The proposed solution is therefore based on the basic concept of providing an assembly aid for arranging at least one fastening element on a first engine component, via which the at least one fastening element can not only be arranged on the first engine component, but can also be held in an assembly position on the first engine component under the action of at least one magnetic element of the assembly aid until the at least one fastening element is fixed to the second engine component. With the aid of the at least one magnetic element of the assembly aid, the assembly aid can be fixed releasably to the first engine component and, during the assembly process, can be readily removed again from the first engine component. The assembly aid therefore holds the at least one fastening element magnetically in the assembly position and, after the end of the assembly of the engine assembly, does not remain on one of the engine components.

In a variant embodiment, the assembly aid can thereby also be reusable, i.e. can be repeatedly used for assembling different engine assemblies. Alternatively, it can be provided that the assembly aid forms at least one point of weakness, in particular at least one predetermined breaking point, at which plastic deformation or failure of the assembly aid is permitted in a specified manner in order to remove the assembly aid again from the first engine component.

The first engine component and the second engine component are secured to each other via the at least one fastening element conventionally by the at least one fastening element being transferred from the assembly position into a securing position. Accordingly, the assembly aid can be removed, for example, before or after the fastening element has been transferred into said securing position. The assembly aid can basically be removed again here before, during or after the securing of the first engine component and the second engine component to each other.

For example, in one variant embodiment, the at least one fastening element is first of all transferred from its assembly position into an intermediate position, in which the at least one fastening element is fixed to the second engine component, the assembly aid is then removed and the at least one fastening element is subsequently transferred from the intermediate position into its securing position, in which the first engine component and the second engine component are secured to each other via the at least one fastening element. If, for example, a screw bolt is provided as the fastening element, the assembly aid initially holds said screw bolt magnetically in the assembly position on the first engine component before or after the first engine component and the second engine component are or have been arranged on each other. The screw bolt is subsequently screwed into an intermediate position in a thread on the other, second engine component to an extent such that the screw bolt is fixed to the second engine component. The assembly aid can now be removed without the screw bolt thereby being released. On the contrary, the screw bolt which is already partially screwed in remains held on the second engine component. After the assembly aid is removed, the screw bolt is then screwed in further and tightened such that finally the two engine components are fixed to each other via the screw bolt screwed in as intended.

Alternatively, it is also possible for the assembly aid to be removed only when the at least one fastening element is in its securing position, in particular without the fastening element having been previously transferred into an intermediate position. In such a variant, the assembly aid remains on the first engine component until the first engine component and the second engine component are secured via the at least one fastening element, for example a screw bolt has been fully screwed in.

If the assembly aid is intended to be removed from the first engine component when the first engine component and the second engine component are secured to each other, at least one section of ramp-like design, in particular a conically widening section, for example, is provided on the at least one fastening element. When the fastening element is transferred from its assembly position into its securing position, the assembly aid can be displaced counter to the action of the at least one magnetic element via a section running in a ramp-like manner or conically. The assembly aid is consequently shifted and ultimately separated from the fastening element. For example, a screw bolt screwed further into its securing position from the assembly position can displace an assembly aid, in the laterally open holding opening of which the screw bolt has been inserted, via a section running in a ramp-like or conical manner on the outer lateral surface of said screw bolt. When the screw bolt is screwed in the direction of longitudinal extent of the screw bolt, a corresponding section of the outer lateral surface of the screw bolt consequently then displaces the assembly aid transversely with respect to the direction of longitudinal extent.

In principle, it can be provided that the first engine component and the second engine component are connected to each other only after the at least one fastening element has been arranged on the first engine component via the assembly aid. The first engine component is therefore connected to the second engine component by the fastening element already held magnetically on said first engine component via the assembly aid. The two engine components are subsequently secured to each other. The first and second engine component can alternatively already be arranged on each other and connected to each other (but not secured to each other) before the at least one fastening element is arranged on the first engine component via the assembly aid and held magnetically in the assembly position. A connection of the first and second engine components prior to their securing to each other is optionally also provided independently of and/or in addition to the at least one fastening element, which is held in its assembly position on the first engine component via the assembly aid, which can be removed again.

The at least one fastening element can be secured against dropping out or falling from the first engine component under the action of gravitational force via the assembly aid, which is held magnetically on the first engine component. Such a variant embodiment is particularly of advantage if, for the securing of the two engine components to each other, the at least one fastening element has to remain accessible on the first engine component from below—with respect to the vertical. Via the assembly aid which can be removed again, the at least one fastening element, even in such an assembly situation, remains captively in the desired assembly position until the two engine components can be secured.

For example, the at least one fastening element is plugged onto the assembly aid and/or suspended on the assembly aid. For the equipping of the assembly aid with the at least one fastening element, the fastening element is therefore, for example, merely plugged into and/or suspended in a holding opening of the assembly aid. A suspension of a fastening element on the assembly aid is understood here as meaning in particular that the at least one fastening element does not fall from the assembly aid in at least one orientation of the assembly aid under the action of gravitational force. For example, a holding element for the at least one fastening element can be designed as a laterally open through opening in which the fastening element is suspended by a first section with a smaller cross-sectional area and at which the fastening element is prevented from dropping through the holding opening via a second section with a larger cross-sectional area. Consequently, the second section with the larger cross-sectional area rests on an edge of the holding opening.

In one variant embodiment, it is provided that the assembly aid is removed from the first engine component by a pull being exerted on the assembly aid. Consequently, the at least one fastening element is held here on the assembly aid in such a manner that—after the fixing of the fastening element to the second engine component—the assembly aid can be separated from the first engine component by simple pulling counter to the magnetic force. By the at least one fastening element already being fixed to the second engine component, the fastening element remains on the engine assembly during said pulling off of the assembly aid. Within the scope of a corresponding variant embodiment of an assembly method, it is consequently provided that, during the assembly, a tensile force is applied which counteracts a magnetic force applied by the at least one magnetic element of the assembly aid, in order to separate the assembly aid from the first engine component. To apply the tensile force, a tension element, for example, is provided on the assembly aid. Such a tension element can be, for example, a clip, a belt or a cable. In one variant embodiment, such a tension element is at least partially or completely composed of Kevlar.

In one exemplary embodiment, it can alternatively or additionally be provided that at least two fastening elements provided for securing the first and second engine components are arranged on the assembly aid, said fastening elements being arranged together on the first engine component via the assembly aid and each being held in an assembly position under the action of the at least one magnetic element of the assembly aid. The assembly aid consequently serves here to specify assembly positions on the first engine component for at least two fastening elements arranged spatially offset with respect to one another. Within the scope of a pre-assembly, a plurality of fastening elements (at least two) can therefore be arranged on the assembly aid. Said plurality of fastening elements are subsequently arranged together on the first engine component via the assembly aid and are held in their respective assembly position via the assembly aid so that the securing of the first engine component and the second engine component can be subsequently undertaken.

The at least one fastening element can be arranged, for example, on a flange section of the first engine component via the assembly aid.

Alternatively or additionally, at least two assembly aids each having a fastening element can be used for assembling the engine assembly. In particular, a plurality of assembly aids can be used in each case for one fastening element or in each case for a plurality of fastening elements on a flange section of the first engine component. Within the scope of the assembly process, said plurality of assembly aids can be removed again from the first engine component simultaneously or successively, for example by a pull being exerted on said assembly aids in each case in the opposite direction to the applied magnetic force of the respective at least one magnetic element.

A further aspect of the proposed solution relates to an assembly aid for assembling an engine assembly.

According thereto, it is provided that the assembly aid has a holding body which is provided for the arrangement of at least one fastening element and on which at least one magnetic element is provided for fixing the assembly aid to an engine component of the engine assembly.

Consequently, at least one fastening element can be held in a certain assembly position via a corresponding assembly aid, wherein the assembly aid can be readily removed again from the engine component, for example even without a tool, because of the at least one magnetic element. A proposed assembly aid is therefore suitable in particular for carrying out a proposed assembly method. Advantages and features explained above and below for variant embodiments of a proposed assembly method thus also apply to variant embodiments of an assembly aid used for this purpose, and vice versa.

For example, the holding body of the assembly aid has at least one holding opening onto which the at least one fastening element can be plugged and/or on which the at least one fastening element can be suspended. In one possible development, such a holding element can also be designed as a laterally open through opening, and therefore a fastening element not only can be plugged into the holding opening along a longitudinal direction, but can also be suspended thereon transversely with respect to the longitudinal direction.

Of course, the holding body can also be designed and provided for arranging at least two fastening elements on the assembly aid. For example, the holding body has at least two holding openings for this purpose.

In one variant embodiment, an intermediate section, for example a web-like intermediate section, is provided between two holding openings of the holding body. The at least one magnetic element can be provided on said intermediate section. Two adjacent fastening elements can therefore be held in a predetermined assembly position via an individual magnetic element.

In order to increase the (magnetic) force with which the assembly aid can be held on a (first) engine component, a plurality of magnetic elements can also be provided on the holding body. A plurality of magnetic elements are thus appropriate in particular if a plurality of fastening elements are intended to be held on the engine component via the assembly aid and therefore a higher weight force acts on the assembly aid attached to the engine component, for example because of gravitational force.

In one variant embodiment, the holding body is designed, for example, in the shape of a circular ring segment. Such a geometry of the holding body is appropriate, for example, in the case of a flange section which is in the shape of a circular ring or is in the shape of a circular disk and on which securing to a further engine component is intended to take place via the at least one fastening element. The holding body designed in the shape of a circular ring segment can therefore extend along a circumference of the flange section. In particular, the assembly aid can be used for pre-positioning a plurality of fastening elements to be provided along said circumference.

The appended figures illustrate exemplary possible design variants of the proposed solution.

Figure 5:
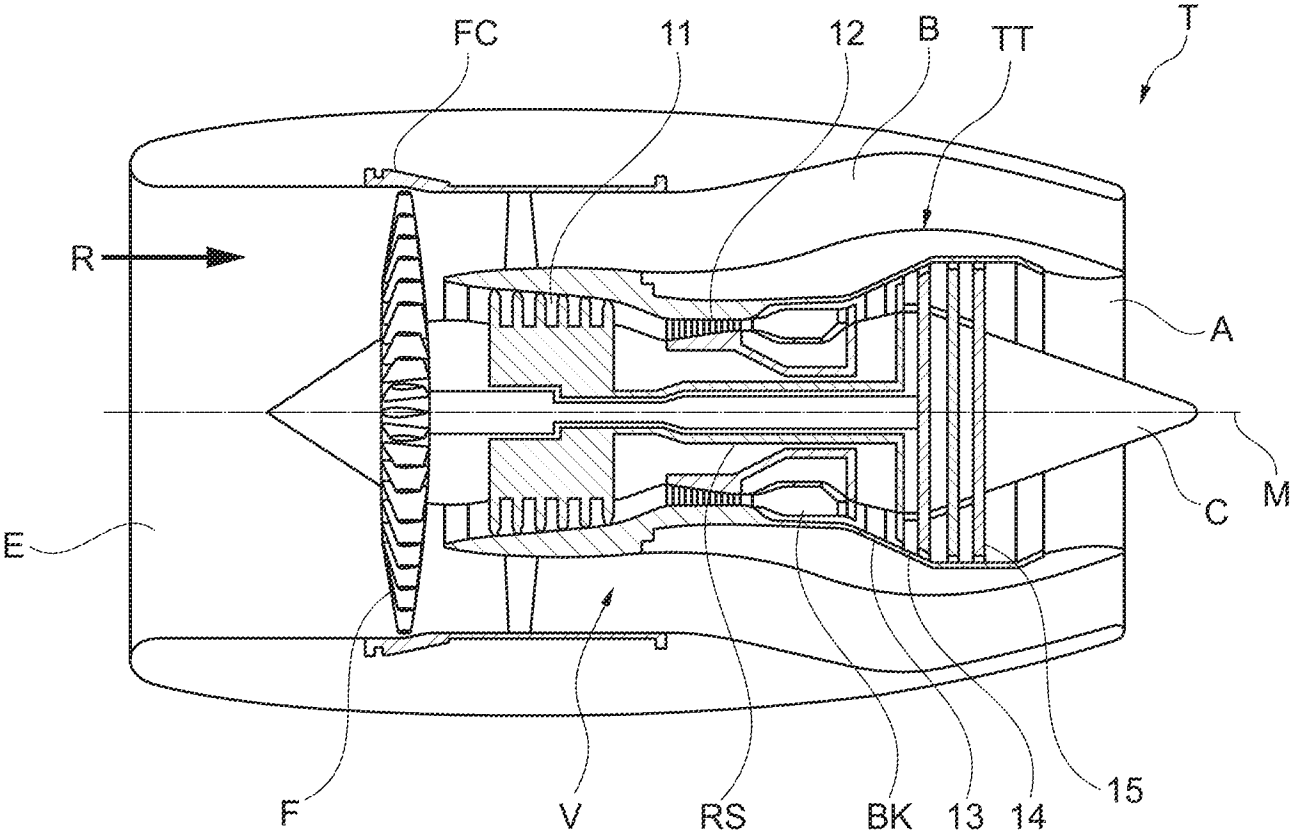
FIG. 5 shows schematically and in a sectional illustration a gas turbine engine, in which a proposed assembly aid and a proposed assembly method are used for connecting engine components.

FIG. 5 illustrates, schematically and in a sectional illustration, a (gas turbine) engine T, in which the individual engine components are arranged one behind the other along an axis of rotation or central axis M. The engine T is designed by way of example as a turbofan engine. At an inlet or intake E of the engine T, air is drawn in along an inlet direction R by means of a fan F. This fan F, which is arranged in a fan casing FC, is driven by means of a rotor shaft RS which is set in rotation by a turbine TT of the engine T. The turbine TT here adjoins a compressor V, which has, for example, a low-pressure compressor 11 and a high-pressure compressor 12, and optionally also a medium-pressure compressor. The fan F on the one hand supplies air to the compressor V and on the other hand supplies air to a secondary flow duct or bypass duct B, in order to generate thrust. The bypass duct B runs here around a core engine, which comprises the compressor V and the turbine TT and comprises a primary flow duct for the air supplied to the core engine by the fan F.

The air conveyed into the primary flow duct via the compressor V enters a combustion chamber section BK of the core engine, in which the driving energy for driving the turbine TT is generated. For this purpose, the turbine TT has a high-pressure turbine 13, a medium-pressure turbine 14 and a low-pressure turbine 15. The energy released during the combustion is used here by the turbine TT to drive the rotor shaft RS and thus the fan F in order to generate the required thrust by means of the air conveyed into the bypass duct B. The air from the bypass duct B and the exhaust gases from the primary flow duct of the core engine flow out via an outlet A at the end of the engine T. In this arrangement, the outlet A generally has a thrust nozzle with a centrally arranged outlet cone C.

In principle, the fan F can also be coupled to the low-pressure turbine 15, and can be driven by the latter, via a connecting shaft and an epicyclic planetary transmission. It is furthermore also possible to provide other gas turbine engines of different configurations in which the proposed solution can be used. For example, engines of this type can have an alternative number of compressors and/or turbines and/or an alternative number of connecting shafts. As an example, the engine can have a split-flow nozzle, meaning that the flow through the bypass duct B has its own nozzle, which is separate from and situated radially outside the core engine nozzle. However, this is not limiting, and any aspect of the present disclosure may also apply to engines in which the flow through the bypass duct B and the flow through the core are mixed or combined before (or upstream of) a single nozzle, which may be referred to as a mixed-flow nozzle. One or both nozzles (whether mixed flow or split flow) may have a fixed or variable region. While the described example relates to a turbofan engine, the proposed solution may be applied, for example, to any type of gas turbine engine, such as an open-rotor (in which the fan stage is not surrounded by an engine nacelle) or turboprop engine, for example.

During the assembly of engine assemblies of the engine T, engine components are in practice generally secured to one another very substantially manually by a fitter, in particular since possible securing points of two engine components are not readily accessible by an assembly robot. Possible fastening elements for securing two engine components to each other also have to be frequently pre-positioned on one of the engine components before the two engine components are arranged on each other since, following a corresponding arrangement and the thus predetermined spatial orientation of the engine components, the corresponding fastening points are still accessible at most to a limited extent.

In practice, it is frequently conventional to provide holding elements for this purpose on one of the engine components, via which holding elements a corresponding fastening element can be held in a pre-assembly position on the one engine component until securing to the other engine component can be undertaken via said fastening element. Corresponding holding elements are integrated here on the engine component and remain on the engine assembly even after the assembly. Said holding elements therefore in particular increase the weight of the engine assembly although they have no function after the assembly.

By contrast, in one variant embodiment of the proposed solution, a separately mountable assembly aid is provided which can be removed again from the engine component during the assembly process. In particular, such a corresponding assembly aid can be used repeatedly for the assembly of a plurality of engine assemblies.

Figure 1A:
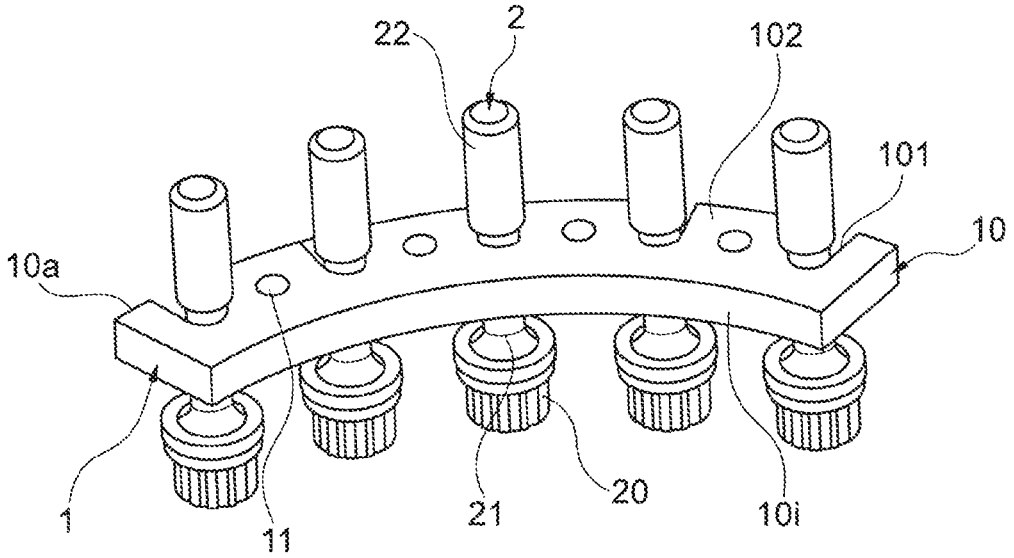
FIGS. 1A-1B show perspective views of a variant embodiment of an assembly aid with a plurality of holding openings for fastening elements suspended thereon and with a plurality of magnets on intermediate webs provided between the holding openings.
Figure 1B:
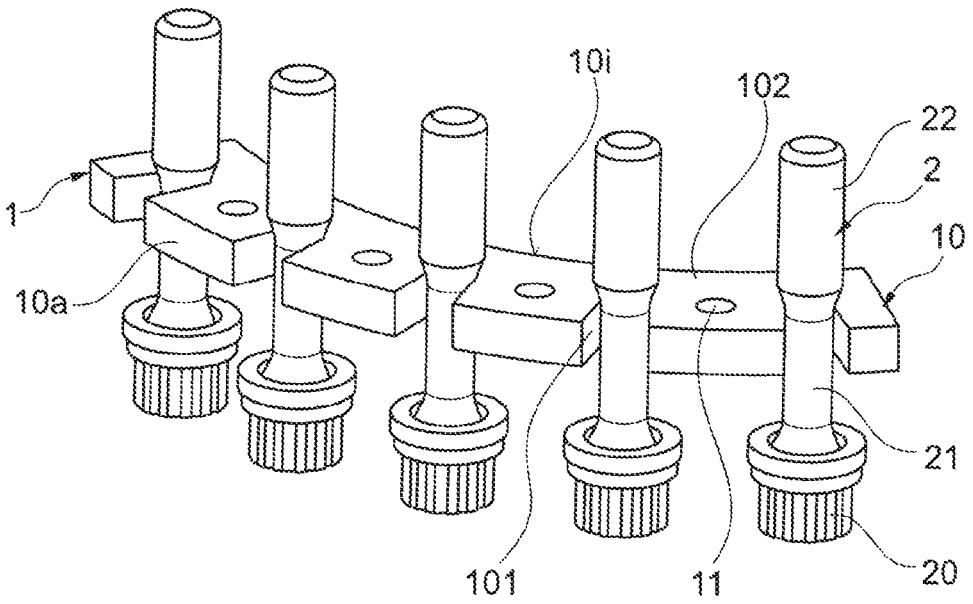

The assembly aid 1 illustrated in FIGS. 1A and 1B is provided with, for example, a holding body 10 on which a plurality of fastening elements—here in each case in the form of screw bolts 2—can be arranged, said fastening elements being provided for securing two engine components to each other. The holding body 10 of the assembly aid 1 of FIGS. 1A and 1B is designed in the shape of a circular ring segment and therefore has a concavely curved inner side 10*i* and a convexly curved outer side 10*a* facing away therefrom.

For the arrangement of the plurality of screw bolts 2 on the holding body 10, a plurality of holding openings 101—here more than two, namely five holding openings 101—are provided on the holding body 10. Each holding opening 101 is designed as a through opening and is additionally laterally open towards the outer side 10*a* of the holding body 10 such that a screw bolt 2 can also be plugged onto and suspended on the holding body 10 via the outer side 10*a*.

Each elongate screw bolt 2 has a bolt head 20 at one end and a threaded section 22 at the opposite end. A stem section 21 which has a smaller diameter than the threaded section 22 and therefore a smaller cross-sectional area extends between the threaded section 22 and the bolt head 20. The diameter of the stem section 21 and the width of a holding opening 101 are coordinated with each other in such a manner that there is space for the stem section 21 in a holding opening 101. By contrast, the threaded section 22 is dimensioned in such a manner that it does not fit through a holding opening 101. Each screw bolt 2 therefore rests in the region of a transition between its stem section 21 and its threaded section 22 on the edge of the respective holding opening 101 and is thus held suspended in a form-fitting manner on the holding body 10 of the assembly aid 1.

Figure 2:
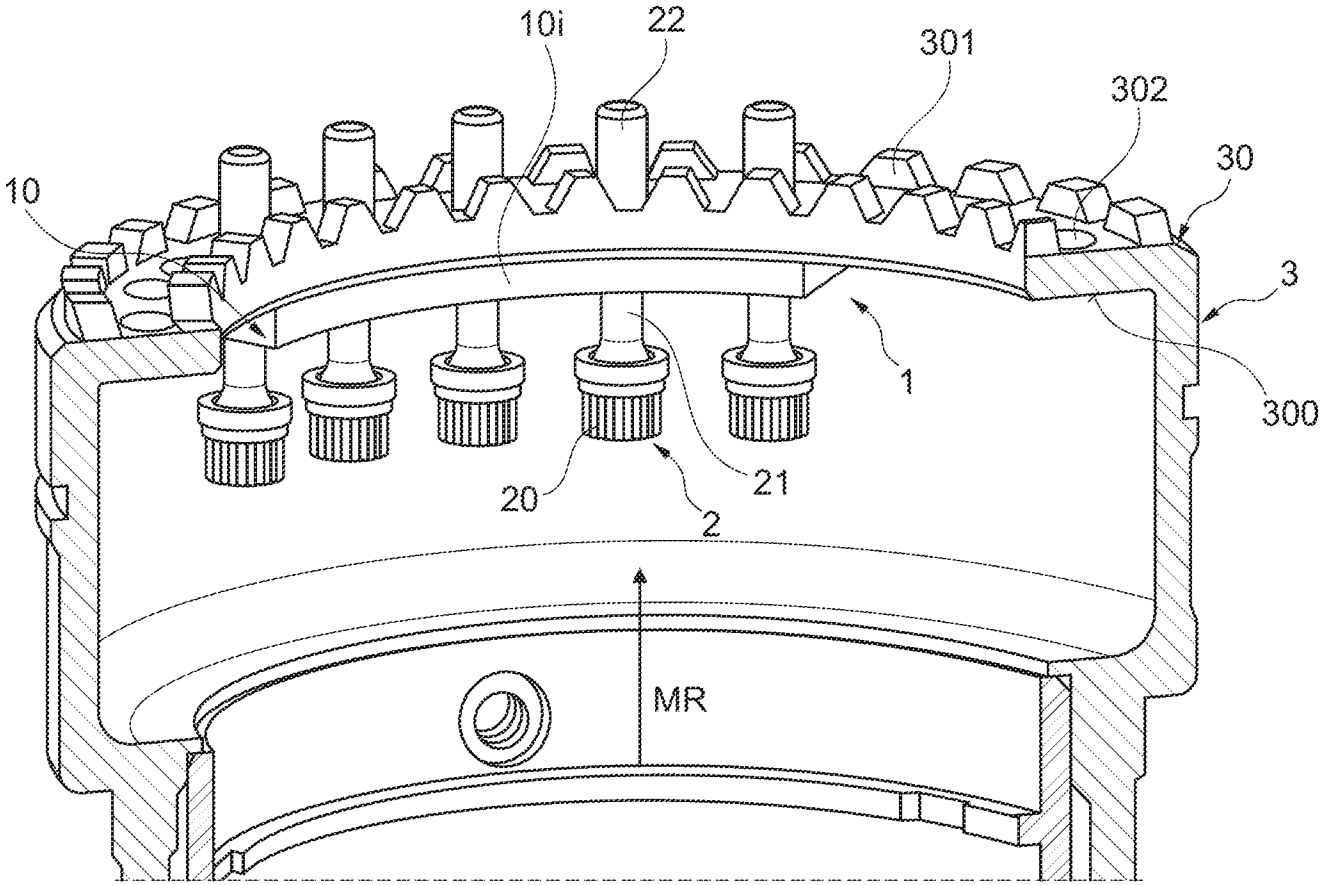
FIG. 2 shows a perspective and partially sectioned view of a first engine component with fastening elements attached to a flange section via the assembly aid of FIGS. 1A and 1B.

A respective intermediate section in the form of an intermediate web 102 extends between the holding openings 101 of the assembly aid 1. A magnet 11 is provided on each of said intermediate webs 102. The assembly aid 1 can be fixed to a (first) metallic engine component 3 according to FIG. 2 via said magnets 11. Under the action of the magnets 10, the assembly aid 1 can therefore be used to arrange a plurality of screw bolts 2 together on the engine component 3 and hold same in an assembly position.

In the illustrated variant embodiment, the screw bolts 2 are required, for example, for securing the first engine component 3 and a second engine component 4 to each other. The first and second engine components 3 and 4 are intended to be secured to each other here via end-face flange sections 30 and 40. Each of said flange sections 30 and 40 here has an end face with a double-row toothing for a form-fitting connection between the two engine components 3 and 4 arranged on each other as specified. However, the final securing of the two engine components 3 and 4 is undertaken only via a plurality of screw bolts 2 to be arranged along the circumference of the flange sections 30 and 40.

For the connection of the two engine components 3 and 4, a (first) engine component 3 has to be positioned here in such a manner that the screw bolts 2 are accessible from below with respect to a vertical. The assembly aid 1 with the plurality of screw bolts 2 is therefore fitted to the flange section 30 along an assembly direction MR, for example counter to the gravitational force. The flange section 30 of the first engine component 3 forms an assembly surface 300 which is in the shape of a circular ring and on which a plurality of through openings or bores 302 following one another along the circumference are provided for the screw bolts 2. Via the magnets 11 of the assembly aid 1, the assembly aid 1 remains locked on the assembly surface 300 of the first engine component 3 and therefore captively holds the screw bolts 2 in an assembly position, in which the threaded sections 22 thereof project through the respective through openings 302 of the assembly surface 300 and protrude on the end face 301 of the flange section 30 between the two toothing rows of the first engine component 3.

If, subsequently, according to FIG. 3A, the second engine component 4 is arranged on the first engine component 3, there is already a form-fitting connection between the two engine components 3 and 4 via the end faces 301 and 401, with the double-row toothings, on their flange sections 30 and 40. Furthermore, through openings or bores 402 are likewise provided on the flange section 40 of the second engine component 4 between the toothing rows. When the first and second engine components 3 and 4 are arranged on each other as specified, the flange-side through openings 302 and 402 of the first and second engine components 3 and 4 are aligned with each other. If the two engine components 3 and 4 are positioned on each other as specified, the threaded sections 22 of the screw bolts 2 held on the first engine component 3 via the assembly aid 1 consequently project into the through openings for 402 of the second engine component 4. A clearance fit is provided here between a through opening 402 and an associated screw bolt 2.

Each through opening 402 of the second engine component 4 is joined by a sleeve section 403 with an internal thread. A screw bolt 2 is fixed to and therefore held on the second engine component 4 only by being screwed into said sleeve section 403.

Figure 3B:
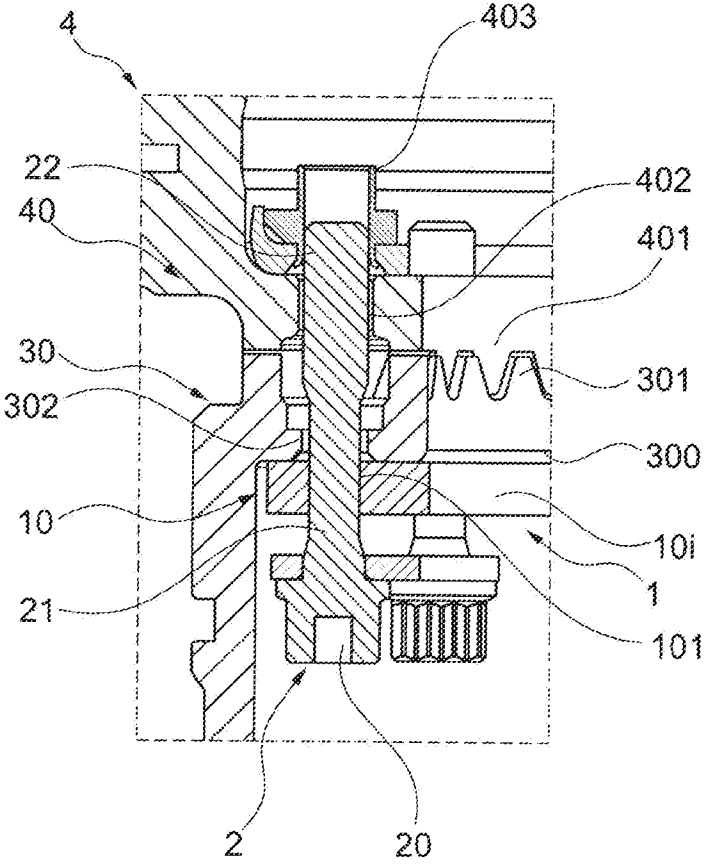
FIG. 3B shows a sectioned illustration comparable to FIG. 3A of a fastening element in an intermediate position, in which the fastening element is fixed to the second engine component and before the assembly aid is removed.
Figure 3A:
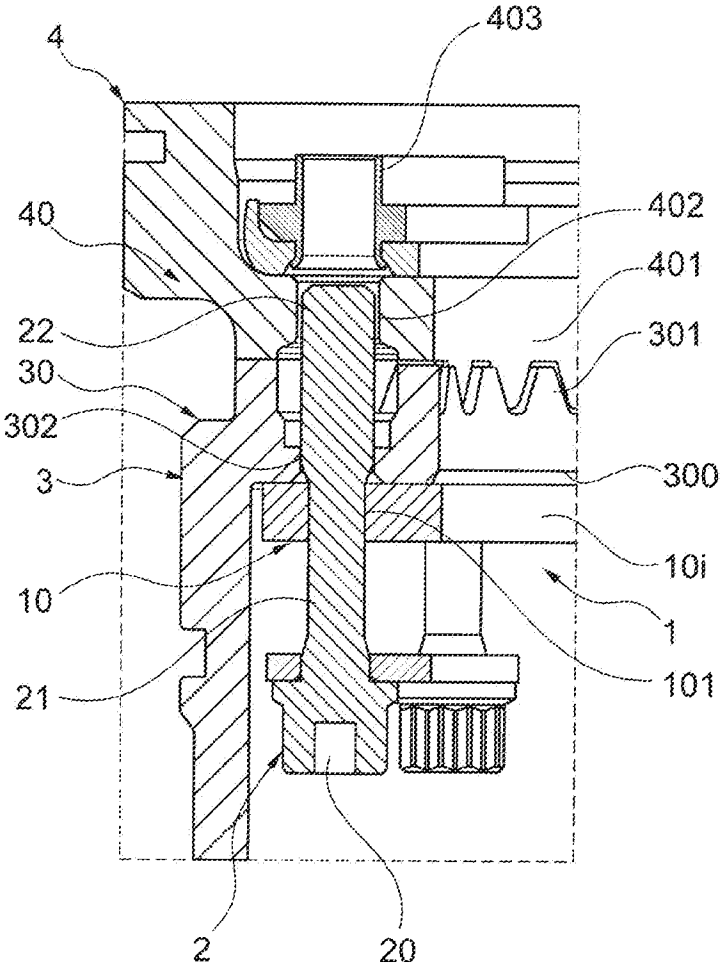
FIG. 3A shows an enlarged and sectioned illustration of the first engine component with a second engine component fitted thereon, with the fastening elements in an assembly position corresponding to FIG. 2.

During the further assembly process, according to FIG. 3B each screw bolt 2 is transferred from the assembly position into an intermediate position by each screw bolt 2 being screwed by a predetermined minimum amount into the associated sleeve section 403 of the second engine component 4. A screw bolt 2 is thereby fixed to the second engine component 4. Accordingly, a screw bolt 2 then no longer lies against the assembly aid 1 via the threaded section 22 and consequently also no longer has to be secured via the assembly aid 1 against dropping out. The assembly aid 1 can accordingly be removed from the assembly surface 300 of the first engine component 3.

If all of the screw bolts 2 which have been previously arranged on the assembly aid 1 are at least partially screwed into associated sleeve sections 403 of the second engine component 4, the assembly aid 1 is pulled off from the assembly surface 300. For this purpose, a pull is exerted, for example, on a tension element which is provided on the inner side 10*i* of the holding body 10. Examples of such a tension element are a belt, a clip or a cable. For example, said tension element is produced from Kevlar. The holding body 10 can be pulled off from the screw bolts 2 through the holding openings 101, which are each open laterally, and can therefore be separated. All that is necessary is to overcome the magnetic force applied by the magnets 11, in order to pull off the assembly aid 1 from the assembly surface 300 of the first engine component 3 counter to the original assembly direction MR.

After removal of the assembly aid 1, the screw bolts 2 are then each completely screwed in such that the two engine components 3 and 4 are thereby secured to each other at their flange sections 30 and 40.

A plurality of assembly aids 1 can be used simultaneously for arranging all of the screw bolts 2 along the circumference of the flange section 30 of the first engine component 3, For example, each assembly aid 1 with its holding body 10 covers a quarter of the circumference of the flange section 30 such that, via a total of four assembly aids 1, all of the screw bolts 2 provided for the securing can be captively positioned in an assembly position on the flange section 30 of the first drive component 3 under the action of the respective magnetic elements 11. After all of the screw bolts 2 have been transferred into the intermediate position, illustrated by way of example for one screw bolt 2 in FIG. 3B, and are therefore fixed to the second engine component 4 (without already taking up their final securing position), the assembly aids 1 are pulled off from the first engine compartment 3. Subsequently, all of the screw bolts 2 are tightened and are therefore completely screwed in such that they are in their respective securing position and the two engine components 3 and 4 are thereby fixed to each other as specified at the flange sections 30 and 40. The assembly aids 1 are thereby reusable and can be used for the following assembly of a further engine assembly.

Figure 4:
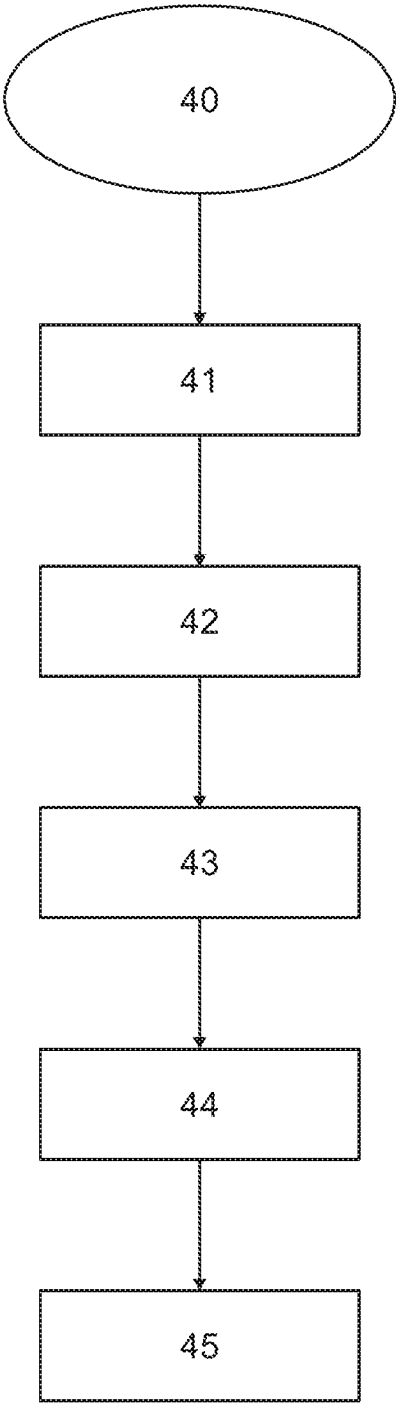
FIG. 4 shows a flow diagram for a variant embodiment of a proposed assembly method.

The basic procedure of an above-discussed variant embodiment of a proposed assembly method is illustrated once again with reference to the flow diagram of FIG. 4.

After the first engine component 3 and one or more assembly aids 1 have been provided in a method step 40, first of all, in a method step 41, a plurality of screw bolts 2 are in each case arranged on the holding body 10 of an assembly aid 1. Then, in a method step 42, the assembly aid 1 with the screw bolts 2 held thereon is fitted along the assembly direction MR onto the assembly surface 300 of the flange section 30 of the first engine component 2. The screw bolts 2 are then held in an assembly position on the first engine component 1 via the plurality of magnets 11 of the assembly aid 1. Optionally, further assembly aids 1 are attached to in each case at least one further screw bolt 2 in order to occupy all of the through openings 302 on the flange section 30 of the first engine component 1 with screw bolts 2.

When the assembly aid(s) 1 is (are) attached, the first engine component 3 can already be positioned as specified relative to the second engine component 3 and therefore can optionally also already be connected to said second engine component 4 at the flange sections 30 and 40. Alternatively, the two engine components 3 and 4 can be fitted to each other only after the first engine component 3 already has the screw bolts 2 held thereon via the assembly aid(s) 1. In particular, a spatial orientation of the engine component 3 can be changed and therefore, for example, the first engine component 3 can be rotated after the first engine component 3 has already been fitted with the screw bolts 2 via the assembly aid(s) 1.

In a subsequent method step 43, the screw bolts 2 are first of all transferred into the intermediate position by each screw bolt 2 being screwed into an internal thread on the second engine component 4. Such an internal thread is formed, for example, by the sleeve section 403 corresponding to FIGS. 3A and 3B.

If all of the screw bolts 2 of an assembly aid 1 are therefore present in a manner at least partially secured on the second engine component 4, the assembly aid 1 is removed and consequently pulled off counter to the applied magnetic force. This is provided in a method step 44 of FIG. 4.

Finally, in a method step 45, the screw bolts 2 are tightened and the first and second engine components 3 and 4 are thereby secured to each other as specified.

LIST OF REFERENCE SIGNS

1 Assembly aid
10 Holding body
101 Holding opening
102 Intermediate web (intermediate section)
10*a* Outer side
10*i* Inner side
11 Magnet
2 Screw bolt (fastening element)
20 Bolt head
21 Stem section
22 Threaded section (fastening section)
3 1st Engine component
30 Flange section
300 Assembly surface
301 End face
302 Through opening/bore
4 2nd Engine component
40 Flange section
401 End face
402 Through opening/bore
403 Sleeve section with internal thread
A Outlet
B Bypass duct
BK Combustion chamber section
E Inlet/Intake
F Fan
M Central axis/axis of rotation
MR Assembly direction
R Inlet direction
RS Rotor shaft
T Gas turbine engine
TT Turbine
V Compressor

The invention claimed is:

1. A method for assembling an engine assembly having a first engine component and a second engine component, the method comprising:

providing the first engine component and the second engine component, providing an assembly aid that includes a holding body, providing at least one fastening element with a threaded end section, engaging the at least one fastening element with the holding body to retain the at least one fastening element to the holding body, positioning and engaging the at least one fastening element on the first engine component via the holding body, holding the holding body in an assembly position on the first engine component with at least one magnetic element, fixing the at least one fastening element to the second engine component to connect the first engine component to the second engine component, and removing the holding body from the first engine component while leaving the at least one fastening element connected to the first engine component and the second engine component.

2. The method according to claim 1, and further comprising providing that the first engine component and the second engine component are connected to each other only after the at least one fastening element has been positioned and engaged to the first engine component via the assembly aid.

3. The method according to claim 1, and further comprising:

transferring the at least one fastening element from an assembly position into an intermediate position, in which the at least one fastening element is fixed to the second engine component, upon removing of the assembly aid from the first engine component, transferring the at least one fastening element from the intermediate position into a securing position, in which the first engine component and the second engine component are secured to each other via the at least one fastening element.

4. The method according to claim 1, and further comprising providing that the at least one fastening element is plugged onto the holding body aid and/or is suspended on the holding body.

5. The method according to claim 1, and further comprising removing the assembly aid from the first engine component by pulling the assembly aid from the first engine component.

6. The method according to claim 1, and further comprising:

providing that the at least one fastening element includes two fastening elements engaging the holding body for securing the first and second engine components;

positioning and engaging the two fastening elements with the first engine component via the holding body;

holding the two fastening elements in an assembly position with the at least one magnetic element.

7. The method according to claim 1, and further comprising arranging the at least one fastening element on a flange section of the first engine component via the assembly aid.

8. The method according to claim 1, and further comprising:

providing that the at least one fastening element includes two fastening elements, providing two of the assembly aid, and using one each of the two fastening elements with each of the assembly aids for assembling the engine assembly.

9. The method according to claim 1, and further comprising:

providing that:

the at least one fastening element includes:

the threaded end section having an end diameter and configured for engaging a bore of the second engine component, a central stem section having a stem diameter smaller than the end diameter, a head section having a head diameter greater than the stem diameter, the holding body includes at least one holding opening configured for receiving the central stem section, the at least one holding opening having a cross-sectional dimension greater than the stem diameter but smaller than the end diameter and the head diameter, such that when the central stem section is positioned in the at least one holding opening, the at least one fastening element is retained to the holding body in an axial direction of the at least one fastening element.

10. The method according to claim 9, and further comprising:

providing that the central stem section has an axial length greater than a thickness of the holding body at the at least one holding opening such that the at least one fastening element is axially movable with respect to the holding body in a given range, while still being retained to the holding body in the axial direction.

11. An assembly aid for assembling an engine assembly, comprising:

at least one fastening element; a holding body configured for positioning the at least one fastening element with respect to an engine component of the engine assembly; at least one magnetic element attached to the holding body and configured for fixing the assembly aid to the engine component; the at least one fastening element including: a threaded end section, the threaded end section having an end diameter and configured for engaging a bore of the engine component, a central stem section having a stem diameter smaller than the end diameter, a head section having a head diameter greater than the stem diameter, the holding body including at least one holding opening configured for receiving the central stem section, the at least one holding opening having a cross-sectional dimension greater than the stem diameter but smaller than the end diameter and the head diameter, such that when the central stem section is positioned in the at least one holding opening, the at least one fastening element is retained to the holding body by the interaction between cross-sectional dimension and the stem diameter in both axial directions of the at least one fastening element; wherein the holding body is shaped as a partially circular ring segment; wherein the at least one holding opening includes two holding openings circumferentially spaced along an arc of the partially circular ring segment; wherein the at least one fastening element includes two fastening elements and the holding body is configured for positioning the two fastening elements in a position of engagement with respect to the engine component; wherein the two holding openings are each shaped as laterally open through openings, positioned in a radial direction open to a radially outer circumference of the holding body, and each of said two holding openings configured to be wider at the radially outer circumference of the holding body than at a radially intermediate position for holding the central stem section to provide both 1) engagement with the central stem section at the radially intermediate position to hold the respective fastening element in in the position of engagement and 2) clearance with respect to the central stem section at the radially outer circumference of the holding body to allow the holding body to be moved transversely with respect to the two fastening elements, to no longer engage the two fastening elements, when the two fastening elements are in the position of engagement with respect to the engine component.

12. The assembly aid according to claim 11, wherein the holding body includes an intermediate section positioned between the two holding openings; wherein the at least one magnetic element is positioned on the intermediate section.

13. The assembly aid according to claim 11, wherein the at least one magnetic element includes a plurality of magnetic elements attached to the holding body.

14. The assembly aid according to claim 11, and further comprising:

the central stem section having an axial length greater than a thickness of the holding body at the at least one holding opening such that the at least one fastening element is axially movable with respect to the holding body in a given range, while still being retained to the holding body in the axial direction.

15. The assembly aid according to claim 11, wherein the at least one holding opening includes at least three holding openings circumferentially spaced along the arc of the partially circular ring segment.

16. The assembly aid according to claim 11, wherein the arc of the partially circular ring segment is less than a quarter circle.

* * * * *